US007503186B2

(12) United States Patent
Bencze et al.

(10) Patent No.: US 7,503,186 B2
(45) Date of Patent: Mar. 17, 2009

(54) METHOD AND SYSTEM FOR CONDENSATION OF UNPROCESSED WELL STREAM FROM OFFSHORE GAS OR GAS CONDENSATE FIELD

(75) Inventors: Istvan Bencze, Hølen (NO); Jan Bosio, Oslo (NO); Guttorm O. Endrestøl, Skedsmokorset (NO); Terje Sira, Skedsmokorset (NO); Dag Thomassen, Fetsund (NO)

(73) Assignee: Institutt for Energiteknikk, Kjeller (NO)

( * ) Notice: Subject to any disclaimer, the term of this patent is extended or adjusted under 35 U.S.C. 154(b) by 368 days.

(21) Appl. No.: 10/540,660

(22) PCT Filed: Dec. 23, 2003

(86) PCT No.: PCT/NO03/00441

§ 371 (c)(1),
(2), (4) Date: Dec. 2, 2005

(87) PCT Pub. No.: WO2004/057252

PCT Pub. Date: Jul. 8, 2004

(65) Prior Publication Data

US 2006/0196226 A1 Sep. 7, 2006

(30) Foreign Application Priority Data

Dec. 23, 2002 (NO) ..... 20026189

(51) Int. Cl.
*F25J 1/00* (2006.01)
*F25J 3/00* (2006.01)

(52) U.S. Cl. ..... 62/613; 62/601; 62/620

(58) Field of Classification Search ..... 62/613, 62/601, 620

See application file for complete search history.

(56) References Cited

U.S. PATENT DOCUMENTS

| | | | | |
|---|---|---|---|---|
| 3,289,408 | A * | 12/1966 | Silvestri, Jr. | 60/678 |
| 4,645,522 | A * | 2/1987 | Dobrotwir | 62/619 |
| 5,140,818 | A * | 8/1992 | Silvestri et al. | 60/678 |
| 6,003,603 | A * | 12/1999 | Breivik et al. | 166/357 |
| 6,085,528 | A | 7/2000 | Woodall et al. | |
| 6,094,937 | A * | 8/2000 | Paurola et al. | 62/613 |
| 6,318,119 | B1 * | 11/2001 | Fischer et al. | 62/620 |
| 6,378,330 | B1 | 4/2002 | Minta et al. | |
| 7,234,321 | B2 * | 6/2007 | Maunder et al. | 62/613 |

FOREIGN PATENT DOCUMENTS

WO WO-96/17766 A1 6/1996

* cited by examiner

*Primary Examiner*—William C Doerrler
(74) *Attorney, Agent, or Firm*—Osha • Liang LLP

(57) ABSTRACT

In a method of condensing an unprocessed well stream from an offshore gas or gas condensate field the well stream taken from one or more wellheads is cooled and directly expanded, isentropically, or near isentropically, to a state in which the pressure is close to that of a storage tank. Part of the well stream is condensed and condensed fractions thereof is drawn off the expander and fed to the storage tank along with condensation products from the exit of the expander. Hence, without any preprocessing, a condensed well stream product is produced which comprises a mixture of liquids and solids which is collected in the storage tank for transport therefrom to land. A system for carrying out the method is also disclosed. The invention makes the condensation of an unprocessed well stream possible without any preprocessing thereof, such as extraction of solid particles, e.g. sands, removal of water, cleaning or drying. Thus, by means of the invention smaller gas or gas condensate fields can be developed in a more cost efficient way.

10 Claims, 4 Drawing Sheets

METHOD AND SYSTEM FOR CONDENSATION OF UNPROCESSED WELL STREAM FROM OFFSHORE GAS OR GAS CONDENSATE FIELD

TECHNICAL FIELD

The present invention relates to a method of condensing an unprocessed well stream from an offshore gas or gas condensate field for the purpose of producing a condensed well stream product that can be collected in a storage tank at sea for transport therefrom to land.

BACKGROUND ART

The development of offshore gas or gas condensate fields of smaller size has often been considered as unprofitable because the costs of bringing the product therefrom onto the market would have been too high. Using technologies known thus far often requires complicated preprocessing and production plants for the preparation of products which are more suitable for the transport away from an exploitation field than an unprocessed well stream. In particular it has been common practice to separate liquids and solid particles, and any heavier hydrocarbons, from the well stream and then to process further constituents of the well stream individually, such as the extracted gas.

An example of the prior art is described in U.S. Pat. Nos. 6,003,603 and 5,878,814, which relates to a method and system for offshore production of liquefied natural gas (LNG), wherein the well stream is supplied from a subsea production plant to a pipeline, in which it is cooled by the surrounding sea water. Then the well stream is supplied to a conversion plant provided on a ship, wherein liquids and solid particles are extracted and at least a part of the remaining gas is converted to liquid form for the transfer to storage tanks on board the ship.

Another example of the prior art is described in U.S. Pat. No. 6,378,330 which relates to a process for making pressurized liquefied natural gas (PLNG) from a gas stream rich in methane, wherein gas is condensed by first being cooled and then expanded. If the stream of natural gas contains heavier hydrocarbons which may freeze out during the liquefaction, they must, however, be removed prior thereto.

Furthermore, U.S. Pat. No. 5,199,266 describes a method of dealing with petroleum gas from an oil or gas production field comprising ethane and heavier hydrocarbons, wherein liquids and solids are separated from a well stream and the gas of the well stream is dried, cooled and possibly processed further prior to condensation and the placement of condensed gas in storage tanks. In U.S. Pat. No. 6,094,937 describes a method of liquefaction and/or conditioning of a compressed gas/condensate from a petroleum deposit especially a compressed gas/condensate flow which has been separated from a crude oil extracted from an offshore oil field.

Using the technologies known thus far and disclosed in the above publications, the feed is in each case subjected to a preprocessing prior to the condensation process itself. In particular it is presupposed that liquids and solids, and any heavier hydrocarbons, are separated in advance. The known techniques referred to all focus on making liquefied natural gas of some quality or other, that may be brought ashore from a location at sea. None of the publications is seen to be concerned with the other constituents of the well stream. According to U.S. Pat. Nos. 6,003,603 and 5,878,814, for example, the extracted liquids and solids are transferred to a container with no indication as to what is done with the contents of the container when it is full.

Therefore, in such offshore production of liquefied natural gas, there may be a problem in respect of such components that traditionally are extracted, such as oily sands and water, which must be transported away, or otherwise be deposited in situ. Common to the approaches disclosed in the publications above is that they also require costly processing plants, sometimes drier/dehydration and regenerator/cleaning systems, too.

Thus, there is a need for a technological solution, by means of which smaller gas or gas condensate fields can be developed in a more cost efficient manner than by the technologies known so far.

DISCLOSURE OF INVENTION

The invention relates to a method of condensing an unprocessed well stream from an offshore gas or gas condensate field, wherein the well stream is fed from one or more wellheads through a pipe coil in the sea to be cooled by the surrounding water to a temperature just above the hydrate temperature of the well stream, and then feeding the cooled well stream to an expander for the expansion thereof.

On this principle background of prior art, the method according to the invention is characterized in that the unprocessed well stream is expanded isentropically, or near isentropically, to a state in which the pressure is close to that of a storage tank, such that part of the well stream is condensed, and condensed fractions of the prior to the expansion, unprocessed well stream are drawn off the expander and fed to the storage tank along with condensation products from the exit of the expander, thereby producing, without any preprocessing, a condensed well stream product made up of a mixture of liquids and solids which are collected in the storage tank for transport therefrom to land.

The invention also relates to a system for carrying out the method according to the invention, by employing an expander, a heat exchanger, a mixing vessel and a storage tank, and corresponding preferred embodiments.

In the method according to the invention there is no need for the well stream to undergo any form of pre-treatment, not even separation. Hence, a processing plant for the implementation of the method may be correspondingly simplified. The method makes it possible to condense an unprocessed well stream into a product comprising a mixture of liquids and solids, i.e. a liquefied unprocessed well stream (LUWS), without any preprocessing of the feed, such as extraction of solid particles, e.g. sands, and removal of water, cleaning and drying.

In the context of the present invention, as it would be known in the present professional area, the expression "unprocessed well stream" is intended to mean the mixture that flows out of a well through a wellhead, or more wellheads joined in a manifold, under the normal production from a gas or gas condensate field without any preprocessing being undertaken, and of a composition, pressure and temperature that may vary from one field to another. An unprocessed well stream as just defined, may contain all possible components and phase mixtures that normally occur when producing from a gas or gas condensate field. Such a flow of fluids is the feed to the process of the invention.

BRIEF DESCRIPTION OF DRAWINGS

An example of how to carry out the method according to the invention is given below by reference to the accompanying drawings, wherein.

MODES FOR CARRYING OUT THE INVENTION

Figure 1:
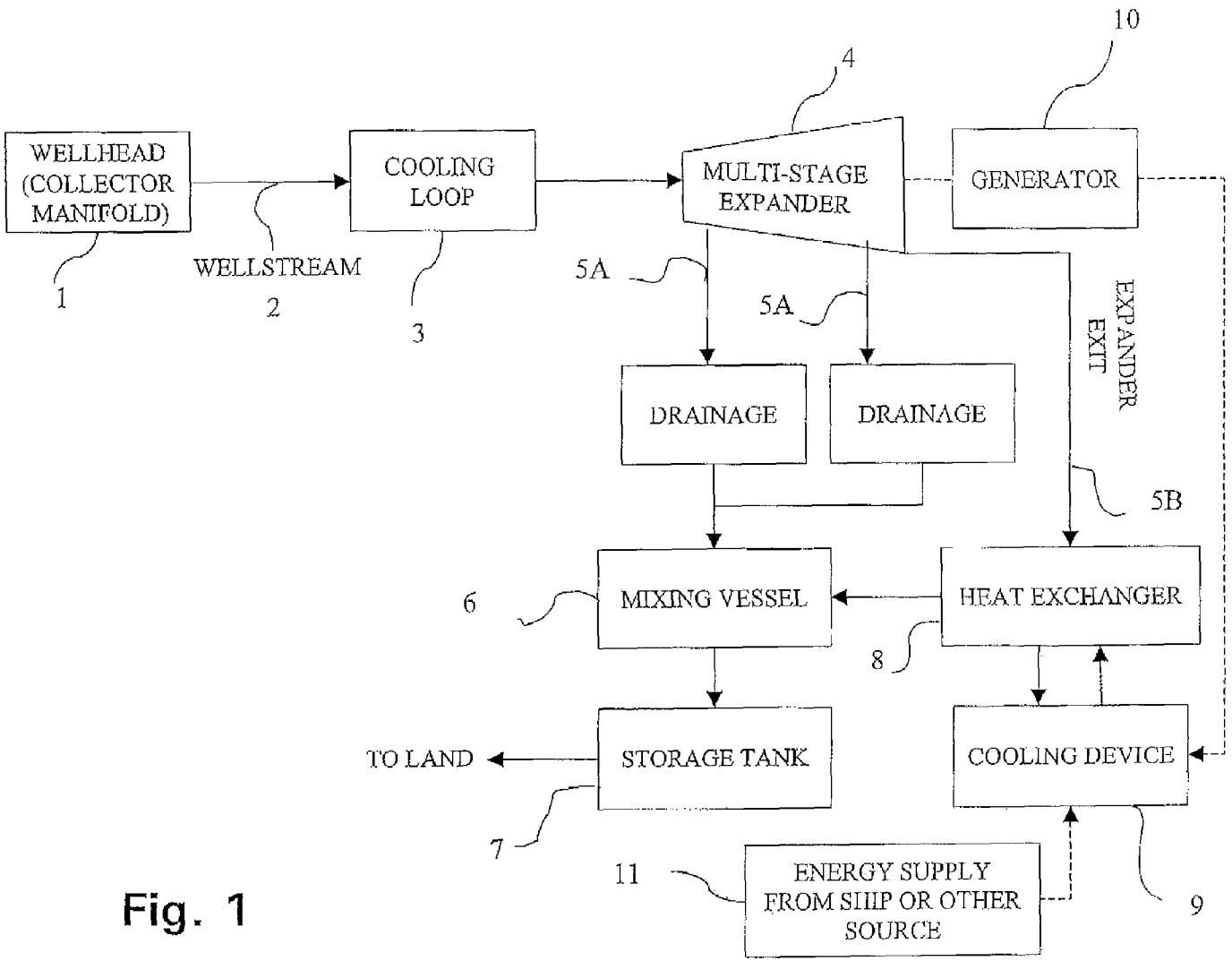
FIG. 1 is a block diagram showing an embodiment of the invention, in which the final cooling is done by means of a heat exchanger and a cooling device included in the process chain.

FIG. 1 is a block diagram showing an embodiment of the invention, which is adapted to a process whereby an unprocessed well stream from a wellhead or well manifold is condensed by expansion and led to a storage tank, and the final cooling is done by means of a heat exchanger and a cooling device included in the process chain.

This embodiment of the invention illustrated in FIG. 1 is intended for being used for the condensation of an unprocessed well stream from an offshore gas or gas condensate field. Through a wellhead 1, or a plurality of wellheads interconnected at a collector manifold, gas is produced, the composition, pressure and temperature of which depending on the field concerned. Without any preprocessing or treatment the well stream 2 is led through a cooling loop 3 such that the temperature of flow is kept a few degrees, e.g. 5° C., above the hydrate forming temperature of the well stream. From the cooling loop 3, which may take the form of a coiled pipe on the sea bed, the well stream is fed to a multi-stage expander device 4 which may be a dynamic expander, or the combination of a static and a dynamic expander.

An example of a conceivable dynamic expander suitable for utilization in the expansion process which tolerates the formation of ice and the wear and tear due to ice particles is described in U.S. Pat. No. 4,771,612, whereas examples of conceivable static expanders for the same purpose are described in each of U.S. Pat. Nos. 5,083,429 and 6,372,019. It also feasible to use some other expanders which are suitable for the purpose.

In the expander 4 the pressure and temperature is gradually lowered such that parts of the well stream is condensed, and liquids are drawn off through draining outlets 5A. The condensation products are drained to a mixing vessel 6 which is also fed with the condensation products from the exit of the expander 5B which on their part are cooled to a desirable temperature prior to the mixing by means of a system comprising a heat exchanger 8 and a cooling device 9 included in the process chain. Thus, the product then accumulating in the storage tank 7 is a condensed well stream product, i.e. a liquefied unprocessed well stream (LUWS) made up of a mixture of condensation products from each of the draining outlets 5A and the expander exit 5B.

Figure 2:
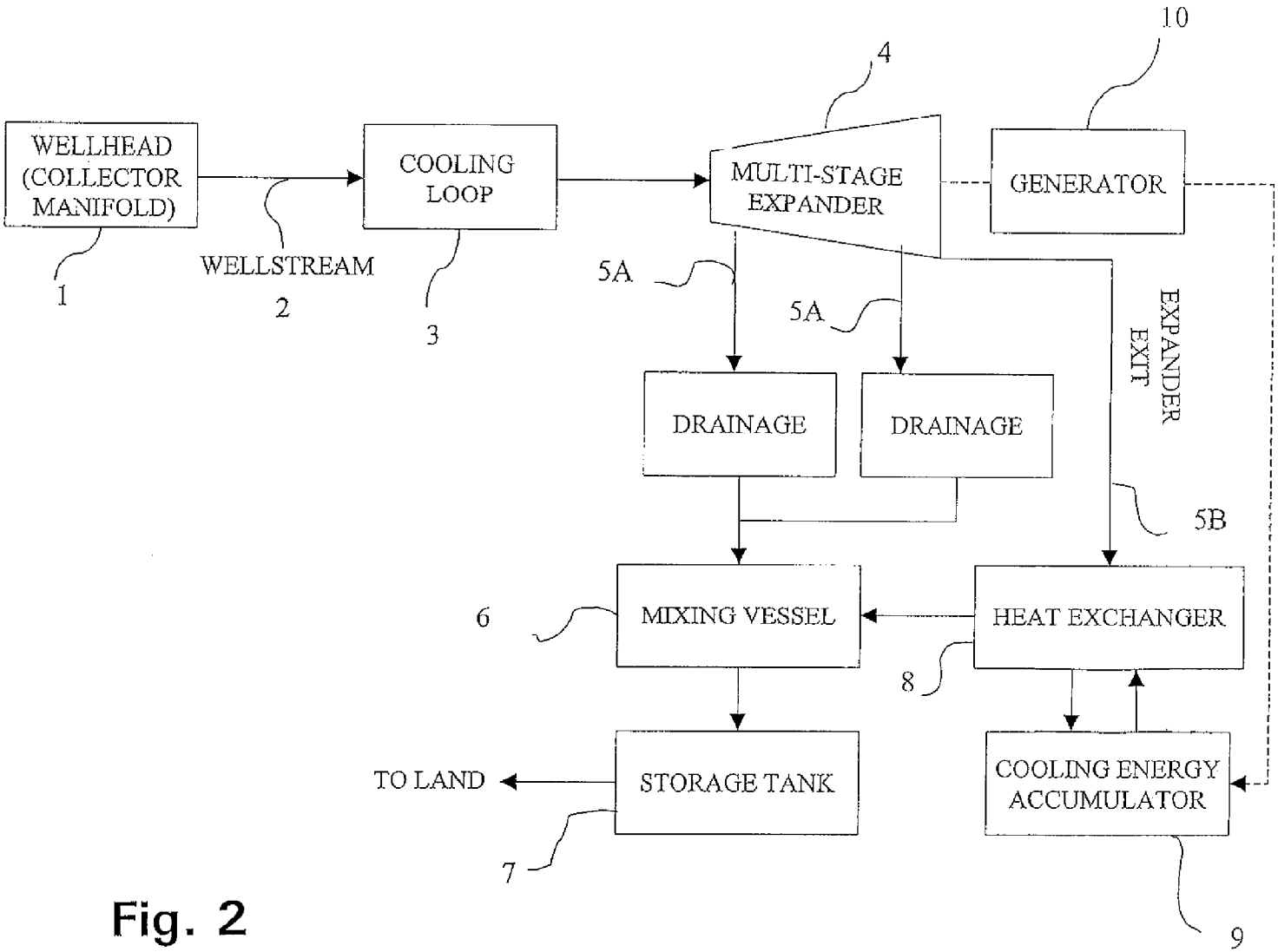
FIG. 2 is a block diagram showing an alternative embodiment of the invention, in which the final cooling is done by means of a cooling device in the form of a rechargeable, portable cooling energy accumulator.

FIG. 2 is a block diagram showing an alternative embodiment of the invention, in which the process is the same as that in FIG. 1 but where the final cooling prior to the arrival of the condensation products at the mixing vessel 6 is done by means of a cooling device which in this case is in the form of a cooling energy accumulator 9 adapted to be recharged ashore and transported to the gas or gas condensate field.

A process according to the method of the invention is now to be explained with reference to FIG. 3 which gives an example of a pressure vs. enthalpy diagram showing the changes in the state of a well stream during the process. In the pressure vs. enthalpy diagram shown the point labeled 6 indicates the state of the well stream at the wellhead 1. The well stream emerging from a gas or gas condensate field is at a high temperature, e.g. 90° C., and a high pressure, which in the diagram shown equals 200 bar. Through the cooling loop 3 the well stream is cooled to a temperature just above the hydrate temperature, corresponding to state 5 in FIG. 3. Then the well stream is expanded isentropically, or near isentropically, to a state 3 in which the pressure is close to that of a storage tank 7.

During the expansion process ⑤→③ part of the well stream condenses and the condensed fraction is led to the storage tank 7 through draining outlets arranged on the expander 4 at the same time as energy is released which is convertible to electric power, as indicated by a generator 10 in FIGS. 1 and 2, approximately corresponding to the shift in enthalpy $h_5$-$h_3$. To cause the well stream to become a mixture of liquids and solids the well stream is cooled from state ③ to state ⑦. For this cooling the energy released from the expansion ⑤→③ is used in addition to an external energy source 11 where required, e.g. from a ship. In this example, the pressure in the storage tank is chosen to be 15 bar but it may be set as low as 1 bar, if this is practical. In such an example the expansion would proceed from ⑤→② and subsequently the mixture would be cooled from ②→① after the expansion process.

Figure 4:
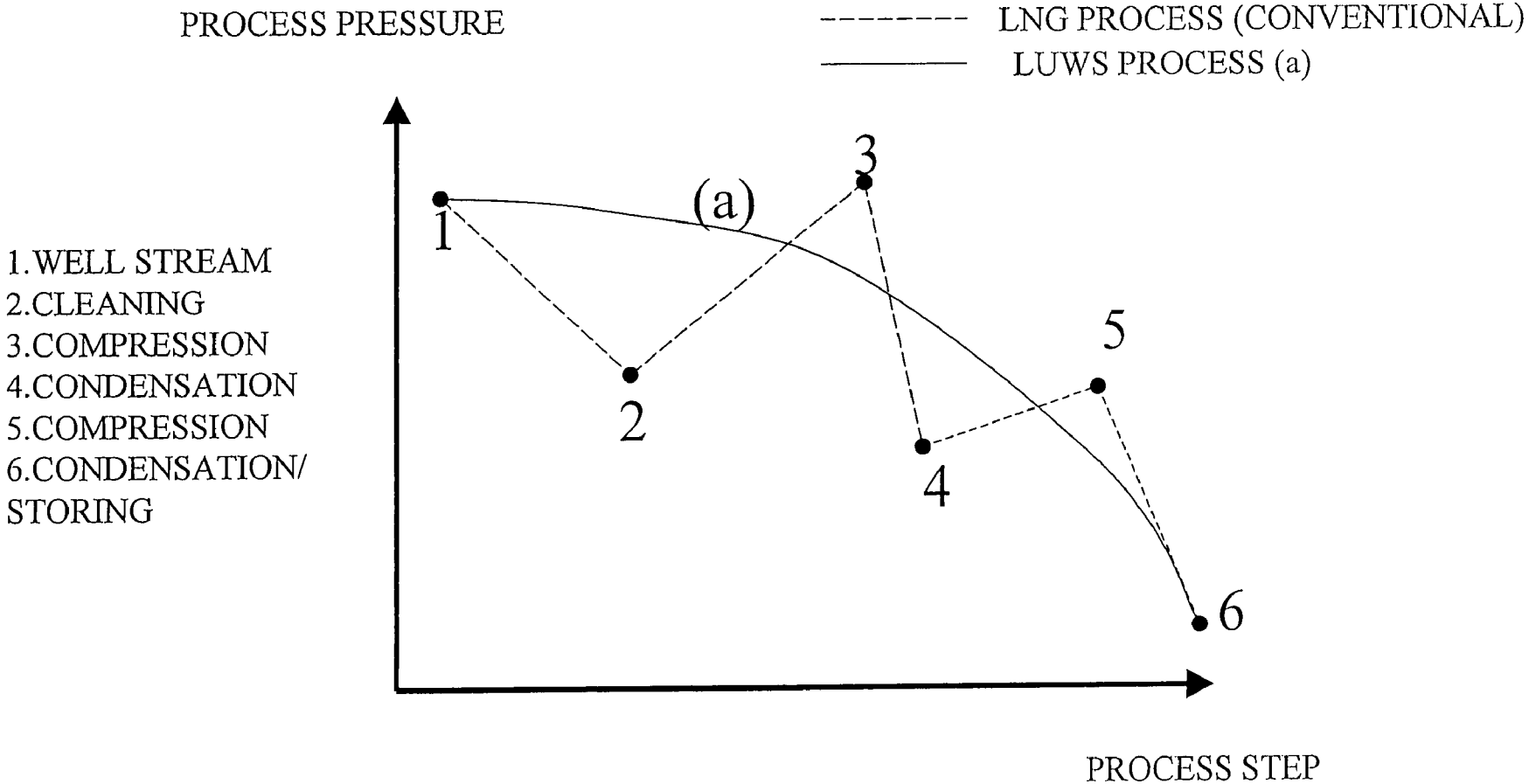
FIG. 4 is a diagram that based on process pressure illustrates the difference between a process performed according to the invention and a conventional condensation process.

The difference between the process according to the invention and the conventional LNG processes is elucidated in FIG. 4. According to the invention the condensation takes place along the solid line (a) in a fully continuous process from wellhead or wellhead manifold to the storage tank 7. On the contrary, the conventional condensation processes take place in a step by step manner and the well stream must undergo a comprehensive preprocessing including separation, drying, cleaning corresponding to points 2 and 4 in FIG. 4, and recompression corresponding to points 3 and 5 in FIG. 4, several times, before it arrives at the storage tank.

One advantage of the invention is that the unprocessed well stream is used as feed to the process. This means use of fewer elements of equipment and, hence, weight and space savings on platforms and production ships at sea, resulting in considerable cost reductions compared to common condensation processes. In addition, the invention represents a potential for saving energy compared to known LNG production processes since there will be fewer processing steps and, therefore, a reduced need for extra pressure increasing capacity, due to a more efficient utilization of the inherent energy at the wellhead or wellhead manifold.

Figure 3:
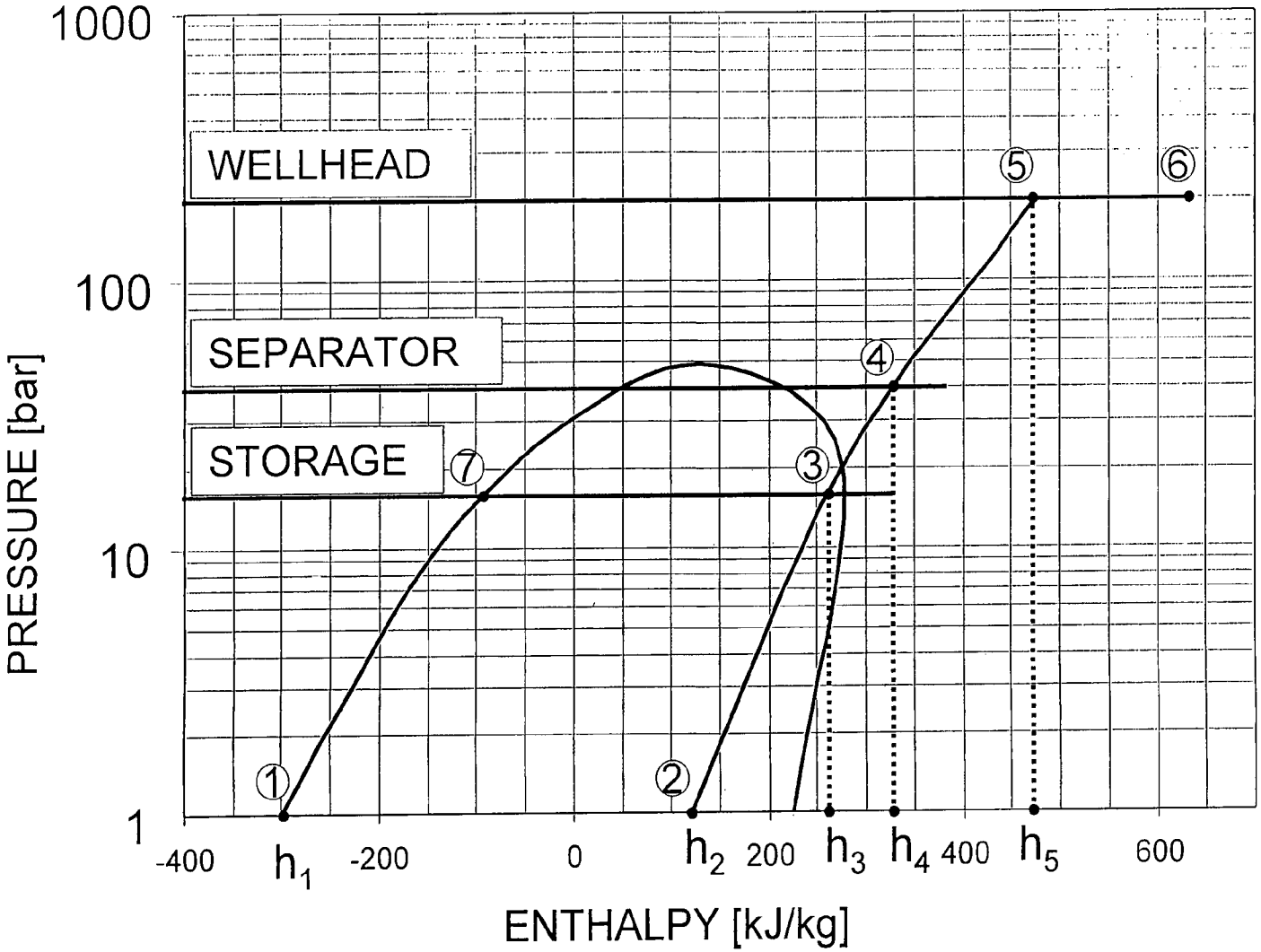
FIG. 3 is an example of a pressure vs. enthalpy diagram showing the changes in the state of a well stream during a process according to the invention.

From FIG. 3 the energy balance of a condensation process also appears:

- the process according to the invention releases energy corresponding to $h_5$-$h_3$, whereas
- a conventional process for liquefaction of natural gas releases energy corresponding to $h_4$-$h_3$, such that
- the energy saving that this invention may give, is $h_5$-$h_4$.

This situation is further demonstrated in Table 1 below which contains results of three simulated isentropic expansion processes under ideal theoretical conditions at a starting pressure and temperature of 200 bar and 20° C. at the well manifold and ending pressures of 1 bar, 15 bar, and 40 bar, respectively. A pressure of 40 bar represents a typical pressure whereat conventional processes carry out separation and cleaning of the gas, and 1 bar and 15 bar represent alternative pressures in the storage tank.

Table 1 relates to an isentropic expansion process under ideal theoretical conditions for a gas comprising about 80% methane, 5% ethane, 2% propane, 2% $N_2$, 5% $CO_2$, and 6% $C_{3+}$, and is based on a starting condition corresponding to state 5 in FIG. 3. The table indicates the values of available energy in the expansion process and the required cooling needed for the condensation of all the fluid, after the expansion, into liquids, for ending conditions corresponding to states 2, 3 of 4 in FIG. 3, respectively.

TABLE 1

| State (see FIG. 3) | Pressure (bar) | Temp. (° C.) | Gas (% weight) | Liquid (% weight) | Free energy (kJ/kg) | Cooling need (kJ/kg) |
|---|---|---|---|---|---|---|
| 2 | 1 | −152.7 | 57.06 | 42.92 | 257 | 316 |
| 3 | 15 | −93.4 | 64.52 | 35.48 | 147 | 287 |
| 4 | 40 | −59.5 | 70.26 | 29.74 | 99 | 238 |

The Gas column indicates the gas percentage by weight after the drawing off of liquid in the expansion process.

The Liquid column indicates the liquid percentage by weight at the drawing off of liquid.

The Free energy column indicates the available free energy in the expansion process.

The Cooling need column indicates the cooling required to make the rest of the gas liquefied.

From the table it can be seen that the energy saved by using the method according to the invention amounts to 99 kJ/kg compared to a conventional process. A conventional process may utilize 33% and 61% of the available free energy when the pressure in the storage tank equals 15 bar and 1 bar, respectively. A process according to the present invention, however, is able to utilize all the free energy of the well stream.

The invention claimed is:

1. A method of condensing an unprocessed well stream from an offshore gas or gas condensate field, wherein the well stream is fed from one or more wellheads through a cooling loop in the sea to be cooled by the surrounding water to a temperature just above the hydrate temperature of the well stream, and then feeding the pre-cooled well stream into an expander for the expansion thereof in the expander, the method being characterized in that the unprocessed well stream is expanded isentropically, or near isentropically, in the expander to a state in which the pressure is close to that of a storage tank, such that part of the well stream is condensed, and condensed fractions of the prior to the expansion, unprocessed well stream, are drawn off between stages of the expander and fed to the storage tank along with condensation products from the exit of the expander, thereby producing, without any preprocessing, a condensed well stream product made of a mixture of liquids and solids (LUWS) which is collected in the storage tank for transport therefrom to land.

2. The method according to claim 1, wherein the condensation products from the exit of the expander are cooled to a desired temperature by means of a heat exchanger and cooling device, prior to being fed to the storage tank.

3. The method according to claim 2, wherein energy generated in the expander by direct condensation therein of part of the well stream, is utilized in the cooling device.

4. The method according to claim 2, wherein the cooling device takes the form of a cooling energy accumulator adapted to be recharged at another location and transported to production site.

5. The method according to claim 1, wherein the storage tank pressure is set between 10 and 20 bar.

6. The method according to claim 1, wherein the storage tank pressure is set close to atmospheric pressure.

7. The method according to claim 1, wherein the expander is made up of a combination of a static and a dynamic expander, the latter having one or more stages.

8. A system for condensing an unprocessed well stream from an offshore gas or gas condensate field, the system comprising:

an expander in which the expansion of the unprocessed well stream is effected isentropically, or near isentropically, to a state in which the pressure is close to that of a storage tank, the expander being provided with a plurality of draining outlets, a heat exchanger for the receipt of condensation products from the exit of the expander, a mixing vessel for the receipt of condensed fractions of the well stream taken from the expander through its draining outlets and for the receipt of condensation products which have passed through the heat exchanger, a storage tank for storing a mixture of liquids and solids (LUWS) received from the mixing tank, for transport therefrom to land.

9. The system according to claim 8, further comprising a cooling device associated with the heat exchanger, and where energy generated in the expander by direct condensation therein of part of the well stream, is utilized in the cooling device.

10. The system according to claim 9, wherein the cooling device takes the form of a cooling energy accumulator adapted to be recharged ashore and transported to the offshore production field.

* * * * *